United States Patent [19]

Wucherpfennig et al.

[11] Patent Number: 4,778,175

[45] Date of Patent: Oct. 18, 1988

[54] ELECTRONIC CONTROL OF RESISTANCE FORCE FOR EXERCISE MACHINE

[75] Inventors: Frederic D. Wucherpfennig; Robert B. Carlson, both of Bloomington, Minn.

[73] Assignee: The Toro Company, Minneapolis, Minn.

[21] Appl. No.: 903,297

[22] Filed: Sep. 2, 1986

[51] Int. Cl.[4] ..... A63B 21/24

[52] U.S. Cl. ..... 272/129

[58] Field of Search ..... 272/129, 130

[56] References Cited

U.S. PATENT DOCUMENTS

| | | | |
|---|---|---|---|
| 3,079,914 | 3/1963 | Bush . | |
| 3,581,739 | 6/1971 | Brandt et al. . | |
| 3,848,467 | 11/1974 | Flavell . | |
| 3,859,840 | 1/1975 | Gause . | |
| 4,060,239 | 11/1977 | Pfleiderer et al. . | |
| 4,082,267 | 4/1978 | Flavell . | |
| 4,084,810 | 4/1978 | Forsman . | |
| 4,337,050 | 6/1982 | Engalitcheff, Jr. . | |
| 4,628,910 | 12/1986 | Krukowski | 272/129 |
| 4,678,182 | 7/1987 | Nakao | 272/129 |

FOREIGN PATENT DOCUMENTS

| | | |
|---|---|---|
| 51377 | 10/1981 | European Pat. Off. . |
| 2045215 | 2/1971 | France . |

OTHER PUBLICATIONS

Cybex leaflet entitled "You and the Cybex II Plus".

Biodex leaflet entitled "Biodex Comparative Feature Chart".

ISOPOWER Leaflet: "Experience Weightlessness".

ISOPOWER leaflet: "What Would Rehab and Sports Medicine be Without a Lot of Weights, Pulleys, Cables and Hydraulic Cylinders"?

ISOPOWER leaflet: "The Weighting Is Over".

ISOPOWER leaflet: "Save Shoulders, Elbows and $22,000".

*Primary Examiner*—Leo P. Picard

*Attorney, Agent, or Firm*—R. Lawrence Buckley

[57] ABSTRACT

An improved electronic control system for an exercise machine of the type having electrically actuated brakes as the resistance force for the exercise. The accuracy of the system in terms of actual resistance force delivered by the machine compared with the user-selected value is improved through techniques for compensating for hysteresis effects in the brakes. When changing the output of the brakes on each half cycle of the exercise in accordance with user-selected values, the system compensates for hysteresis effects in the brake in responding to increased current, decreased current, or steady-state current conditions. A simple but effective system is provided to let the user select "soft" limits for a particular range of motion of the exercise apparatus. The limits are in the form of an audible beep rather than a hard mechanical limit, and they are set as the system learns the desired range of motion from the user on a first cycle through the exercise.

9 Claims, 10 Drawing Sheets

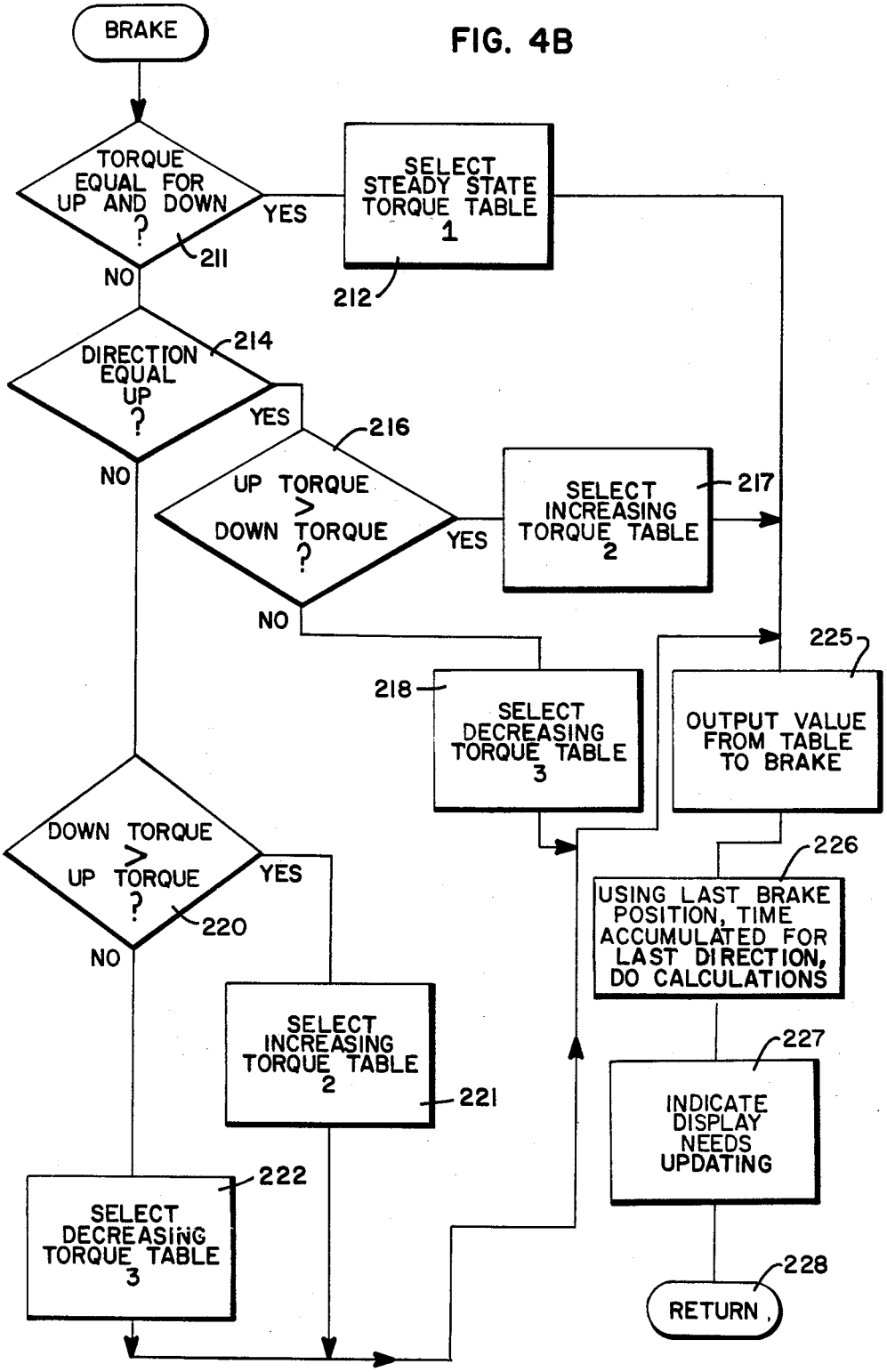
FIG. 4B
BRAKE
TORQUE EQUAL FOR UP AND DOWN ?
YES
NO
211
SELECT STEADY STATE TORQUE TABLE 1
212
DIRECTION EQUAL UP ?
214
YES
NO
216
UP TORQUE > DOWN TORQUE ?
YES
NO
SELECT INCREASING TORQUE TABLE 2
217
218
SELECT DECREASING TORQUE TABLE 3
225
OUTPUT VALUE FROM TABLE TO BRAKE
DOWN TORQUE > UP TORQUE ?
YES
NO
220
SELECT INCREASING TORQUE TABLE 2
221
SELECT DECREASING TORQUE TABLE 3
222
226
USING LAST BRAKE POSITION, TIME ACCUMULATED FOR LAST DIRECTION, DO CALCULATIONS
227
INDICATE DISPLAY NEEDS UPDATING
228
RETURN

ELECTRONIC CONTROL OF RESISTANCE FORCE FOR EXERCISE MACHINE

TECHNICAL FIELD OF THE INVENTION

The present invention relates to exercise machines for exercising many of the major muscle groups of the body by means of an electrically controlled resistance element which generates a force to be overcome by the person using the machine. More specifically, the present invention relates to an improved electrical controller for the electrically operated resistance element of the exercise machine.

BACKGROUND OF THE INVENTION

In U.S. patent application Ser. No. 675,366 filed Nov. 27, 1984 and assigned to the assignee of the present application, there is disclosed an improved exercise machine which makes use of electrically controlled brakes as the resistance force producing elements for the exercise. By applying controlled energization to the brakes, the resistance force, or torque, generated by the brakes along an output shaft may be controlled. The exercise machine is especially adapted so that the resistance elements can be moved to different positions and orientations, and different adaptors can be attached to the brake shafts, so that the machine can be easily converted or adapted to exercise any of a number of different major muscle groups of the body. The control system provided allows the user to select the effort level or resistance force provided by the brakes, and further to select separate resistance forces for opposite directions of movement of the brake shaft corresponding to the opposite half cycles of each exercise repetition. A user can thus set different effort levels for muscle extension and contraction, and the apparatus automatically detects reversal of direction of movement at the end of each half cycle and applies the appropriate preselected resistance force. It is believed that this flexibility of setting different effort levels for each half cycle of the exercise repetition allows for optimum exercise of the various muscle groups.

While this system can provide optimum bidirectional exercise, the present invention provides certain improvements which can lead to better performance and greater usefulness of the exercise machine, particularly for certain types of users. One improvement of the present invention is in the area of accuracy of the selected resistance force levels. It has been discovered that under certain circumstances the actual resistance force or torque provided by the brake unit may vary from the preselected value. The amount of variation may not be significant for most users under most circumstances, but in the worst case can amount to a noticeable difference. This is particularly true in the field of physical therapy, where there is a great need for precisely controlled resistance levels. It has been determined that these inaccuracies result from differences in the torque response of the brake to changed input currents or steady-state input currents. Further, it has been determined that the torque response of the brake in a nonsteady-state condition will vary depending on whether there has been an increase or decrease in applied current. These nonsteady state response characteristics, referred to as hysteresis effects herein, can lead to errors in the resistance force of the exercise machine which, although insignificant for most purposes, can be significant under certain conditions for certain types of users. The present invention provides means for compensating for these hysteresis effects, to provide better control of the resistance force and to eliminate or reduce any differences between the selected resistance force and the resistance force actually obtained.

Another feature of the invention is to provide a range of motion indication so the user can concentrate the bidirectional exercise over a predetermined range of motion. According to this feature, the user can program or select upper and lower, or inner and outer, "limits" for the range of motion for a given exercise. The limits are not hard limits which would actually prevent further movement of the machine and which might cause injury to the user, but preferably are "soft" limits which only provide an indication to the user, such as a tone or an indicator light, when each limit is reached. While generally applicable to all types of exercise, this feature is particularly useful in the field of professional physical therapy, so that the therapist can design a specific exercise for a patient over a prescribed range of motion.

SUMMARY OF THE INVENTION

One aspect of the present invention provides an improved and more accurate control system for an exercise machine of the type which provides bidirectional exercise benefit through the use of at least one electrically operated resistance unit having a shaft rotatable in opposed first and second directions and with the resistance force developed being a function of the electrical energization applied thereto. Exercise attachments allow the user to exert a counteracting torque on the shaft in both directions of movement while a control system controls the energization applied to the shaft and therefore the resistance force. The control means stores first and second values corresponding to the selected resistance forces for the two directions of exercise, and means are provided for sensing shaft movement. The control system includes means responsive both to the selected values and the direction of shaft movement for outputting electrical energization levels to the resistance means for the two directions of movement. The electrical energization level is a function both of the selected value for the resistance force for the present direction, and also a function of the relative magnitude of that resistance force in relation to the resistance force for the previous direction of movement so as to compensate for hysteresis effects in the resistance unit and cause it to generate a resistance force for each direction which is substantially equal to the selected resistance force.

According to another aspect of the invention, a user-selectable and programmable limited range mode is provided. Means are provided which are responsive to user-selected end positions or limits of movement of the shaft of the resistance means and which provide an indication to the user when the limit positions are reached during each exercise cycle to thereby define a limited range of motion for the exercise. In a preferred embodiment of the invention, the limits or end positions are selected by the user through the use of means operative when activated by the user for setting the limits of shaft rotation when the apparatus is moved through a first exercise cycle. Thereafter, the control system provides an indication to the user, which in the preferred embodiment is in the form of an audible beep, when the limits are reached during each exercise cycle.

BRIEF DESCRIPTION OF THE DRAWING

In the drawing,

FIGS. 4A through 4G are flowcharts for the microprocessor of the control system of FIG. 2.

DETAILED DESCRIPTION OF THE PREFERRED EMBODIMENT

Figure 1:
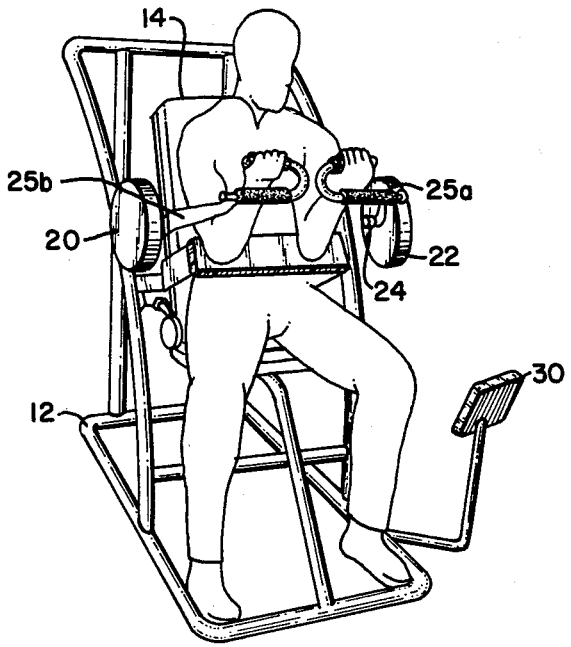
FIG. 1 is an overall view of a type of exercise machine with which the present invention can be used.

As previously mentioned, the improved control system of the present invention can be advantageously used in connection with the type of exercise machine disclosed in U.S. patent application Ser. No. 675,366, and a machine of this type is indicated in FIG. 1. The exercise machine of FIG. 1 includes a frame 12 suitably configured for supporting a seat 14, and a pair of electromagnetic resistance elements in the form of electromagnetic brakes 20 and 22, which are disposed on opposite sides of the machine. The brakes have output shafts 24. Exercise attachments 25*a* and 25*b* are attached to shafts 24. In the configuration shown in FIG. 1, exercise attachments 25*a* and 25*b* are for grasping by the hand for exercise of the biceps and triceps as the user alternately pulls and pushes the exercise attachments through an arc segment which is repeated for each exercise repetition. The preferred exercise machine as disclosed in the above-mentioned patent application has means for altering the position of brakes 20, 22 along appropriate frame members and fastening them in new positions, either higher or lower than indicated in FIG. 1, together with means for altering the position and tilt of seat 14. In addition, swivel brackets (not shown) are provided for changing the orientation of brakes 20, 22 between vertical and horizontal orientations. Also, means are provided for attaching a number of differently configured exercise attachments 25*a* 25*b*. These different attachments and adjustment positions are provided so that the machine can be set up for exercising different major muscle groups of the body, i.e., different muscle groups in the legs, arms, back, etc.

The resistance force or torque provided by brakes 20, 22 is controlled by an electronic controller, explained in greater detail below, which includes a control panel 30 mounted where it can be accessed by the operator to enter resistance values for the exercise, and where the operator can observe exercise progress data displayed on the panel during the exercise. All or part of the electronics for the control can be contained in control box 30, or, part of the controller, for example, power supplies and power outputs, etc., can be mounted in another electronic chassis (not shown) mounted at some convenient location, for example, toward the back of the frame where it will be out of the way.

Figure 2:
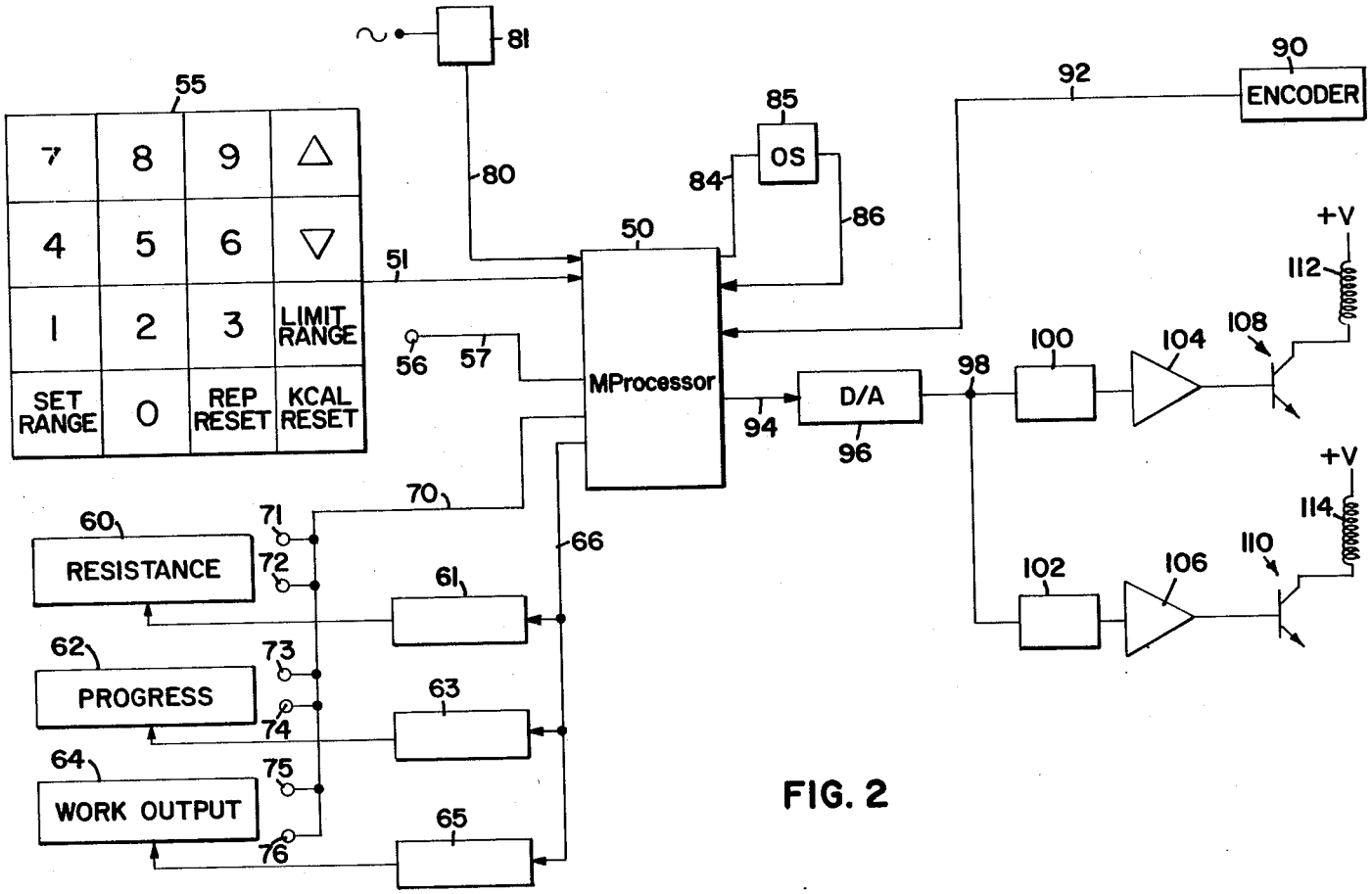
FIG. 2 is an electrical block diagram of a control system for an exercise machine according to the present invention.

Although the control system of this invention can be implemented in a number of different forms, the preferred form is a microprocessor-based controller which is shown in block diagram form in FIG. 2. The connections between functional blocks are generally indicated in FIG. 2 by single control lines. It will be appreciated, however, that in practice multiple data or control lines may be required, depending upon the number and type of ports of the microprocessor and other circuits, i.e., whether serial or parallel, and depending upon requirements for providing chip select and clock signals to individual circuits, as is generally known in the art. The connections of FIG. 2 are therefore shown as single lines for convenience and clarity of illustration, and it will be appreciated that individual ones of the control lines of FIG. 2 may represent a number of parallel data paths. Also, power and ground connections to the circuits have been omitted.

In FIG. 2, reference 50 designates the microprocessor which includes a ROM memory containing the operating program for the control system as explained in greater detail below with reference to FIGS. 4A–4G. Microprocessor 50 includes a number of input and output ports which are connected to the various other devices. Data line 51 connects from the keyboard 55 to an input port of microprocessor 50. Keyboard 55 is provided to enable the user to enter resistance settings into the controller, to set the limit range of movement, and to reset certain displayed quantities. Keyboard 55 is a conventional key pad comprising an array of 16 switches, one for each of the digits 0–9, plus two direction indicating switches with "up" and "down" symbols. Reset switches are provided for resetting total repetition count and total kilocalories (Kcal) of work output. Two more switches, labeled LIMIT RANGE and SET RANGE, are provided for use in connection with the exercise range limit feature of the invention, as explained in greater detail below. An indicator light 56 is mounted on the panel adjacent the LIMIT RANGE switch and is used to indicate when that mode is activated. Indicator light 56 may be an LED with a suitable transistor driver as is generally known, and it is controlled by the microprocessor via control line 57.

Three numeric digital displays 60, 62 and 64, are provided for displaying numeric data for torque, repetitions and work output, respectively. These can comprise liquid crystal displays, LED displays, or other displays, and preferably provide four digits of display each. Displays 60, 62 and 64 are driven respectively by display drivers 61, 63 and 65, which in turn receive data from a data line 66 from microprocessor 50. These drivers include latches for holding data received from the microprocessor to be displayed.

A plurality of mode indicator lights 71–76 are provided on the control panel for indicating the current modes of the displays, and these are controlled by microprocessor 50 through data line 70. Indicator lights 71–76 can consist of LEDs with suitable transistor drivers as is generally known. In the preferred embodiment, these LED indicator lights are used in conjunction with the displays to provide six different types of output information. Display 60 is used to display the resistance force in foot-pounds of torque. Since in general the force can be set separately for the alternate directions of movement of the brakes, i.e., up or down (or out or in, if the brakes are oriented with their shafts vertically positioned for a given exercise), the display is switched automatically during exercise to always display the current resistance force. Indicator 71 is for the up or out direction, and is so indicated by suitable indicia on the panel, and indicator 72 is associated with the down or in direction. Thus, as the user exercises, indicator 71 lights during each "up" or "out" movement (both of which are associated with the up arrow key on keyboard 55) and display 60 shows the resistance force for this direction. Indicator 72 lights during each "down" or "in"

movement while display 60 shows the resistance force for that direction.

Similarly, indicator lights 73 and 74 are used to indicate the appropriate quantity as the numeric display in display 62 is changed on each half cycle of a repetition. Specifically, on the up or out stroke, indicator light 73 is activated and display 62 indicates repetitions per minute, and on the down or in stroke, indicator light 73 lights up and display 62 indicates total repetitions since reset. Appropriate legends "reps per min" and "total reps" are associated with indicators 73, 74, respectively, on the display to inform the user.

In like manner, display 64 and indicators 75, 76 are used to indicate work output in kilocalories per hour on the up stroke, and total kilocalories on the down stroke.

A real time clock input is provided to the microprocessor via control line 80 from switch 81. Switch 81 is a transistor switch connected to the 60-cycle line current, so that line 80 switches at the 60 Hz line frequency for use as the clock reference.

Another output of microprocessor 50 connects via line 84 to a one-shot circuit 85. The output of this circuit connects via line 86 to the microprocessor. This one-shot circuit serves as a "watchdog" function, explained in greater detail below.

Reference number 90 indicates a shaft position encoder associated with the output shaft of one of the brakes. This encoder, which can be of conventional design, provides digital output signals over data path 92 to microprocessor 50, indicating the angular position of the shaft at any given moment. The use of this position information by the control system is described in greater detail below.

Microprocessor 50 provides an output on data path 94 which is used to control the electromagnetic brakes. Data path 94 connects to digital-to-analog converter 96, and the analog voltage output thereof is applied via lead 98 to a pair of networks 100, 102. These networks have zero offset and gain adjustment controls. The output of network 100 connects to the input of amplifier 104, and its output is connected to power transistor 108 which in turn is connected for controlling the current through winding 112 of one of the brakes. Similarly, the output of network 102 is connected to the input of amplifier 106, and its output is connected to power transistor 110 which is connected for controlling the current through winding 114 of the other brake. Networks 100 and 102 are provided as factory adjustments for zero offset and gain adjustment for each channel, so that the channels can be calibrated and balanced to each other, and so that compensation can be provided for variances in the torque-current characteristics of individual brakes due to manufacturing tolerances and the like.

In operation, the user can set the desired resistance forces by entering a numeric value of foot-pounds and touching the appropriate up or down key. A second numeric value can be entered followed by the other direction key. In the preferred embodiment values can be zero to 200 foot-pounds. In practice this is only limited by the capability of the brake units selected for the design of the machine. Total repetitions and kcals from previous sessions can be cleared by the reset buttons. The selected values for resistance force are stored internally in the microprocessor. As exercise begins, the direction of motion, i.e., up or out, or down or in, can be determined by the microprocessor by reading shaft encoder 90 and comparing to prior values. The appropriate preselected resistance force for the current direction of motion is then output to digital-to-analog converter 96 and applied through the two amplifier channels to control the appropriate currents in windings 112 and 114 to thereby cause the brakes to produce the preselected resistance force. Reversal of motion on the other half-cycle of an exercise repetition can again be detected by the microprocessor by reading encoder 90 and comparing with prior position readings, and the preselected resistance force for that direction is then output to the brakes.

The brakes 20, 22 may be any type of electrically operated brakes as are generally known in the art. Preferably, the brakes are electromagnetic brakes of the type which includes a generally circular case and an output shaft projecting from one side. The output shaft is connected to, or forms a part of, the armature of the brake. This is surrounded by a stator portion associated with electrical windings, such that when current is passed through the windings a magnetic field is generated which resists rotation of the armature. In this manner the rotation of the output shaft of the brake will be resisted by a variable force that is directly dependent upon the current supplied to the winding.

As previously mentioned, it has been noticed that in the operation of an exercise apparatus employing such brakes, certain inaccuracies in the resistance forces can occur under certain circumstances. In some cases the actual resistance force or torque delivered by the machine varies from the selected value, but in other cases it does not. The amount of error or variance is usually not significant because absolute numeric accuracy of the resistance force is not usually important, so long as the set force is approximately correct and is repeatable so that a user can compare and monitor his long-term progress in the use of the machine. However, in the worst case the variance between the actual and set resistance values might be noticed by some users. Also, in the field of professional physical therapy exact resistance values can be very important. Accordingly, the controller of this invention provides means for correcting and avoiding the above-noted inaccuracies.

Figure 3:
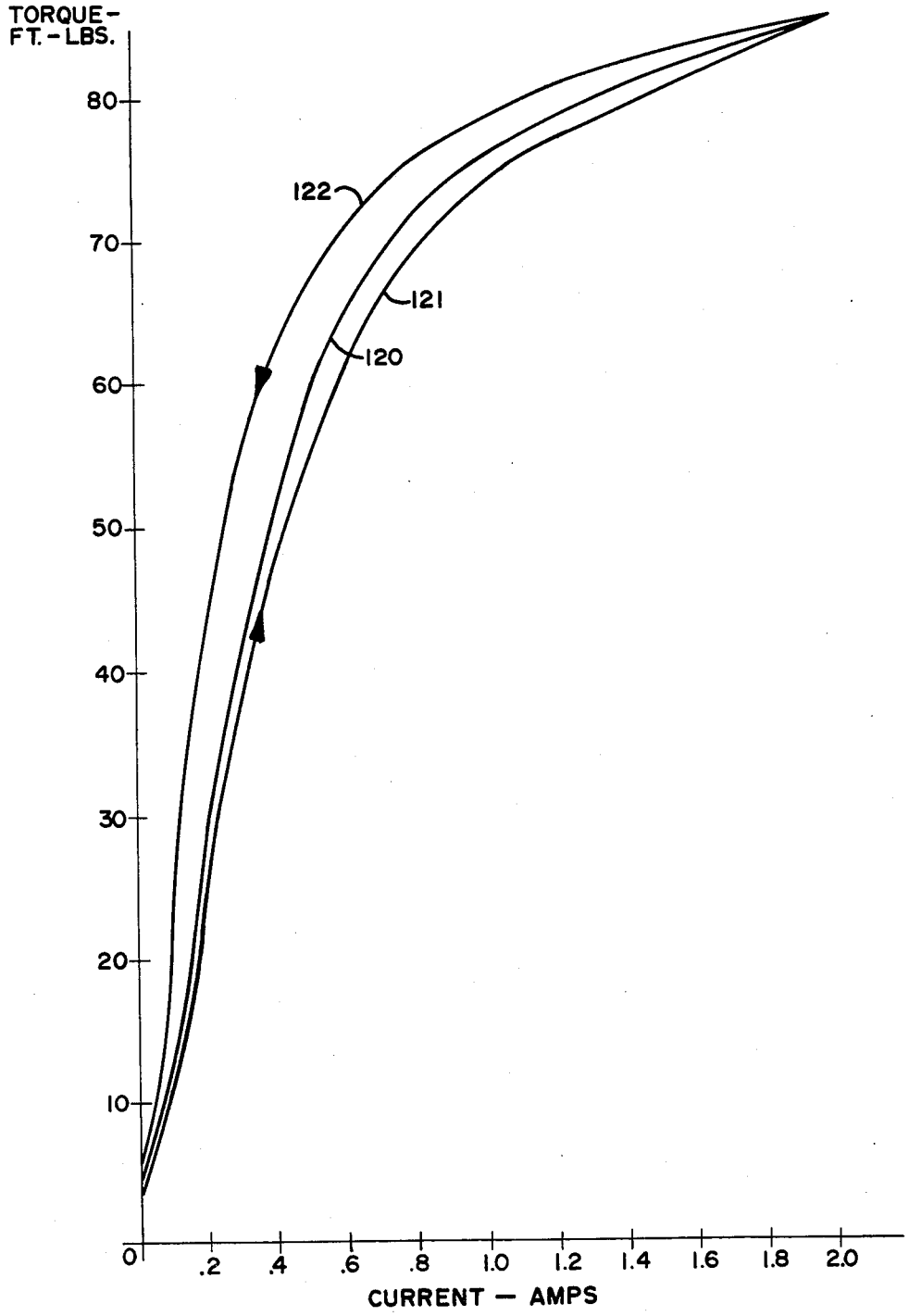
FIG. 3 is a graph illustrating the hysteresis effect of certain electromagnetic brakes used in an exercise machine.

It has been determined that the above-noted inaccuracies result from variances in the torque output of the brake for a given current under different circumstances. The response of a typical brake is indicated in FIG. 3. Curve 120 represents a typical specification of torque output of a brake as a function of applied current as specified by the brake manufacturer. Curve 120 exhibits a somewhat nonlinear but increasing torque response with increasing applied current. The nonlinearities of curve 120 can be dealt with through known control system techniques so that the desired output torque can be made to correspond to the numeric input.

However, it has been determined that curve 120 is valid only for steady-state operation of the brake, and that steady-state operation may not be achieved until the brake shaft has been turned through several revolutions after a given current has been applied. Not only does the transient response of the brake prior to attaining steady-state vary from curve 120, but also it has been determined that the variation is different depending upon whether the current has been increased or decreased from a previous setting. In many uses of electromagnetic brakes other than in an exercise machine, the transient response is not significant, because the brake shaft will typically be rotating as a part of some machine that is being controlled, and steady-state is quickly achieved through just a few rotations. However, when the same type of brake is applied to an exercise machine, the transient response can introduce significant errors. A single repetition of an exercise will rotate the brake shaft through only a fraction of a turn, with the result that it may take a number of repetitions at a given current energization level before a steady-state condition is reached. Further, since the controller of the present invention permits the selection of different resistance levels for the two opposite motions of a complete repetition, the energizing current will be switched twice on each repetition with the result that the brake never achieves steady-state operation during the exercise.

Careful measurements of the response of a typical electromagnetic brake yields two additional curves 121 and 122 in FIG. 3, which are for transient response for increasing and decreasing current conditions, respectively. Specifically, curve 121 is a plot of initial torque (not steady-state torque) of the brake for an input current which is an increase from a prior current. Curve 122 is a plot of the initial torque of the brake for changes in input current which are a decrease from prior current levels. For any given point on curve 121 or 122, continued rotation of the brake without change in current would bring the torque to the steady-state value of curve 120. An examination of curves 120, 121 and 122 shows that while many of the hysteresis errors will be relatively small, errors of as much as 30% to 40% can result in the 0.2 to 0.5 -amp range in comparing the decreasing current curve 122 to the steady state current curve 120. This would mean that if current were relatively high, for example, one amp, on the up-stroke and were then reduced to about 0.5 amp in an attempt to obtain the torque suggested by curve 120, the actual initial torque obtained on curve 122 could be a significant percentage higher than what might have been intended in reliance on curve 120.

Summarizing the above, when the exercise machine is operated in the most common mode wherein the selected resistance forces are different for the two opposite motions of a complete exercise repetition, the brakes are always operating in their transient response conditions and never achieve steady state operation, regardless of how many repetitions of the exercise are completed. This is because the current is switched at the end of each half cycle of each repetition, so that the brakes are continually switched between response curves 121 and 122, and the brake shafts are only moved through a fraction of a rotation before being switched again. If not compensated for, this can lead to the above-noted inaccuracies.

The present invention compensates for the above-noted hysteresis effects by providing different current output commands to the brakes for each preselected resistance force, depending upon whether the current is increasing, decreasing, or remaining the same as compared with the preceding output current value. This is done by providing three different look-up tables which the microprocessor uses for the cases of increasing current, decreasing current, and steady-state current. In a typical exercise repetition cycle which uses a higher resistance force in one direction than the other, the microprocessor will use the appropriate increasing current or decreasing current table when changing current at the beginning of each half cycle of each repetition. The current thus selected will compensate for the above-noted hysteresis effects and result in providing the selected resistance for each half cycle of each repetition.

In the case where the resistance force for both half cycles is the same, the brake will reach its steady-state condition within a few cycles, so therefore the table for steady-state torque-current characteristics will be used for providing output current to the brakes. Technically, in the case of equal resistance forces for both half cycles there will be an initial hysteresis effect for the first couple of repetitions after the current is initially output to the brake at the beginning of a set of exercises. However, since the current in this case remains constant and does not change on each half cycle, the brakes will achieve steady state operation within just a few repetitions of the exercise. The control system does not attempt to compensate for this type of hysteresis because the condition where both half cycles use the same force level is not commonly used, and if used, the initial start-up hysteresis effect is usually not noticeable; and in any event steady state is achieved after only a couple of repetitions.

Another feature of the invention provides range limit indications to the user as an aid for limiting the exercise to a range between preselected angular position limits. The system provides "soft" limits in the form of an audible tone or other indication to the user that the limit has been reached, rather than a "hard" limit of a mechanical stop, which is used in some other types of exercise machines. It is believed that abrupt mechanical stops can have the potential for injury.

The limit feature is activated by pushing the LIMIT RANGE button on the front panel, following which indicator light 56 will be activated to confirm that this mode has been selected. The user may then push the SET RANGE button on the front panel, then move the exercise machine through a complete cycle. The torque is automatically set to zero for this initial cycle. The microprocessor then "learns" the range of motion for this first cycle and thereafter emits a beep at the end positions to indicate the points for reversal of direction to the user. If the user wishes to set new limits, for example, for another exercise, it is only necessary to press the SET RANGE button again and move the machine through a desired range the first time, to set the new limits.

The operation of the controller is explained in greater detail with reference to the program flowcharts of FIGS. 4A–4G.

Figure 4A:
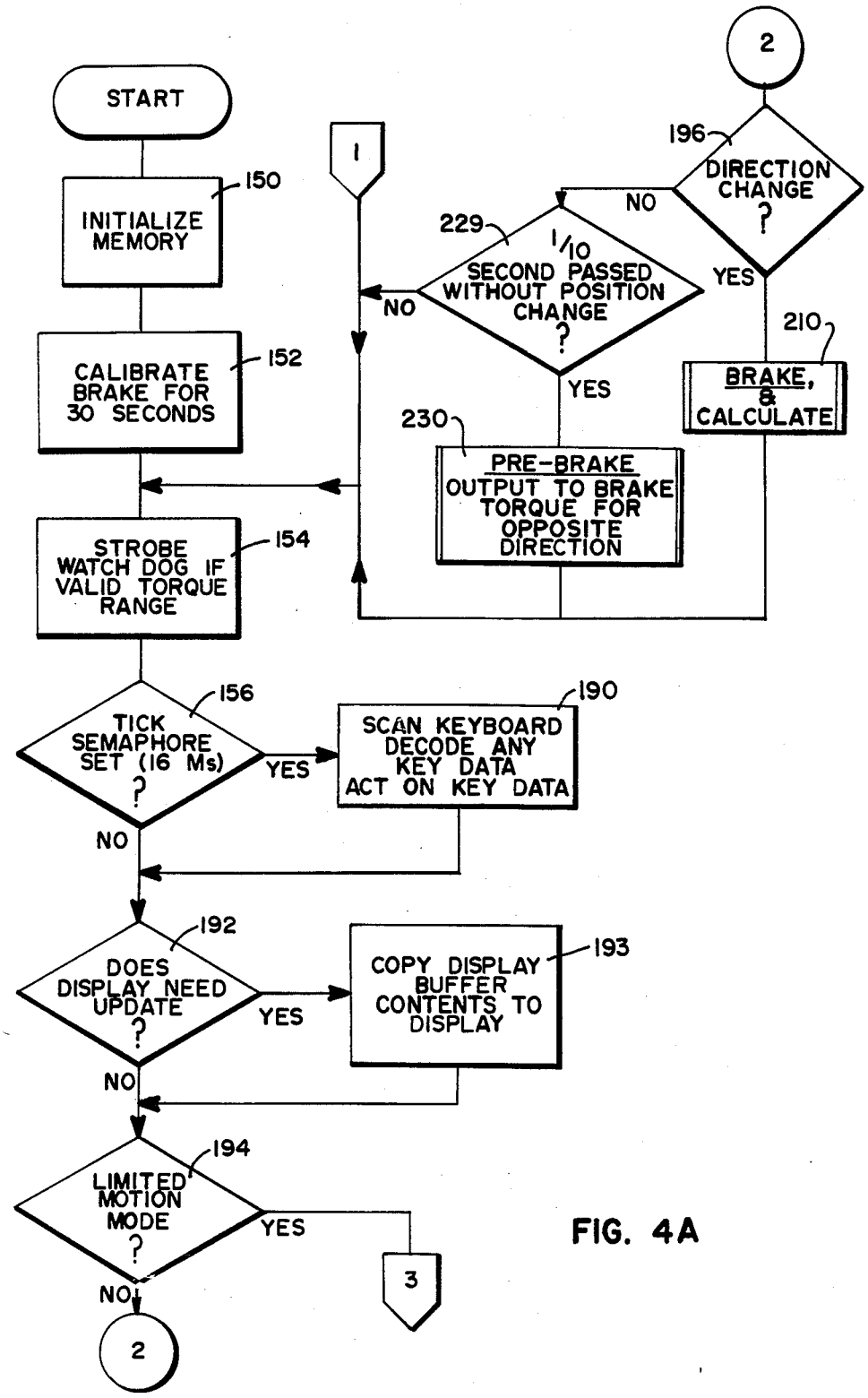

Upon initial power-up, the program starts as indicated in FIG. 4A with segment 150 which initializes the memory and variables used in the operation of the program. Control then passes to segment 152 which provides for 30 seconds' calibration of the brakes. This consists of applying a sawtooth or triangular wave form of current to the brakes which serves to condition the brakes for more accurate operation during the subsequent exercise. Control then passes to segment 154, in which the watchdog function is strobed. This refers to the one-shot 85 of FIG. 2, which serves to guard against certain types of possible malfunction. It is theoretically possible that some error condition, for example, caused by electrical interference or the like, could cause faulty data or instruction bits to occur, and the watchdog feature protects against system hang-up. First, segment 154 causes the microprocessor to check for valid torque ranges. In the preferred embodiment the torque can be from zero to 200 ft/lbs, but if, due to some error as noted above, the RAM values are corrupted and the stored values are beyond the valid range, then the watchdog would not be strobed, i.e., one-shot 85 would not be set. This would result in one-shot 85 eventually timing out, and when it times out it causes a system reset. In normal operation, the microprocessor will continually pass through the program and return through segment 154, continually resetting the watchdog one-shot, with the result that it never times out. If, however, there were an error causing the program to hang up, the watchdog would not be restrobed, and it would time out, resulting in resetting the system.

After segment 154, control passes to decision segment 156, which tests to see whether the tick semaphore is set. The tick semaphore is controlled by a timing process shown in FIG. 4F, beginning at Start 170. This interrupt occurs upon activation of switch 81 (FIG. 2) which occurs at a 60-Hz rate. 0n each cycle, the interrupt causes execution beginning at START 170, which then passes to decision segment 172. A tick corresponds to 16 milliseconds, and a tick semaphore is used in order to keep track of ticks and seconds for use in timing considerations in other parts of the program. At decision block 172, if the semaphore tick is not set, it is set at segment 174, and in any case execution passes to segment 176, where the tick counter is incremented. At decision segment 178, the tick counter is tested, and if the number of ticks does not equal 60 the interrupt process ends at 180. If the number does equal 60, the tick counter is cleared and a seconds counter is incremented at segment 182. A seconds semaphore is then tested at segment 184 and if necessary set at segment 185, after which the interrupt ends at 180.

Returning again to segment 156 of FIG. 4A, the tick semaphore is used to slow the scan of the keyboard to avoid detecting key bounces which might occur if the keyboard were scanned at too fast a repetition rate. At segment 190, the keyboard 55 of FIG. 2 is scanned, and any key data is decoded and acted upon. This would include, for example, setting modes or entering values.

Control then proceeds to segment 192 which tests an internal flag to see whether the display needs to be updated. If not, control passes to segment 194. If update is needed, at segment 193 values from a display buffer are copied into the display, causing the appropriate values to appear in displays at 60, 62, and/or 64 as previously described.

At segment 194 the microprocessor checks whether the limited motion mode has been previously activated by the user. In the case that limited motion mode is not selected, control passes to segment 196, which checks to see whether a change in direction of the brake shafts has occurred, indicating that the user has reversed directions of exercise, thus beginning the next half cycle. As previously mentioned, brake shaft position is measured by digital encoder 90.

Figure 4C:
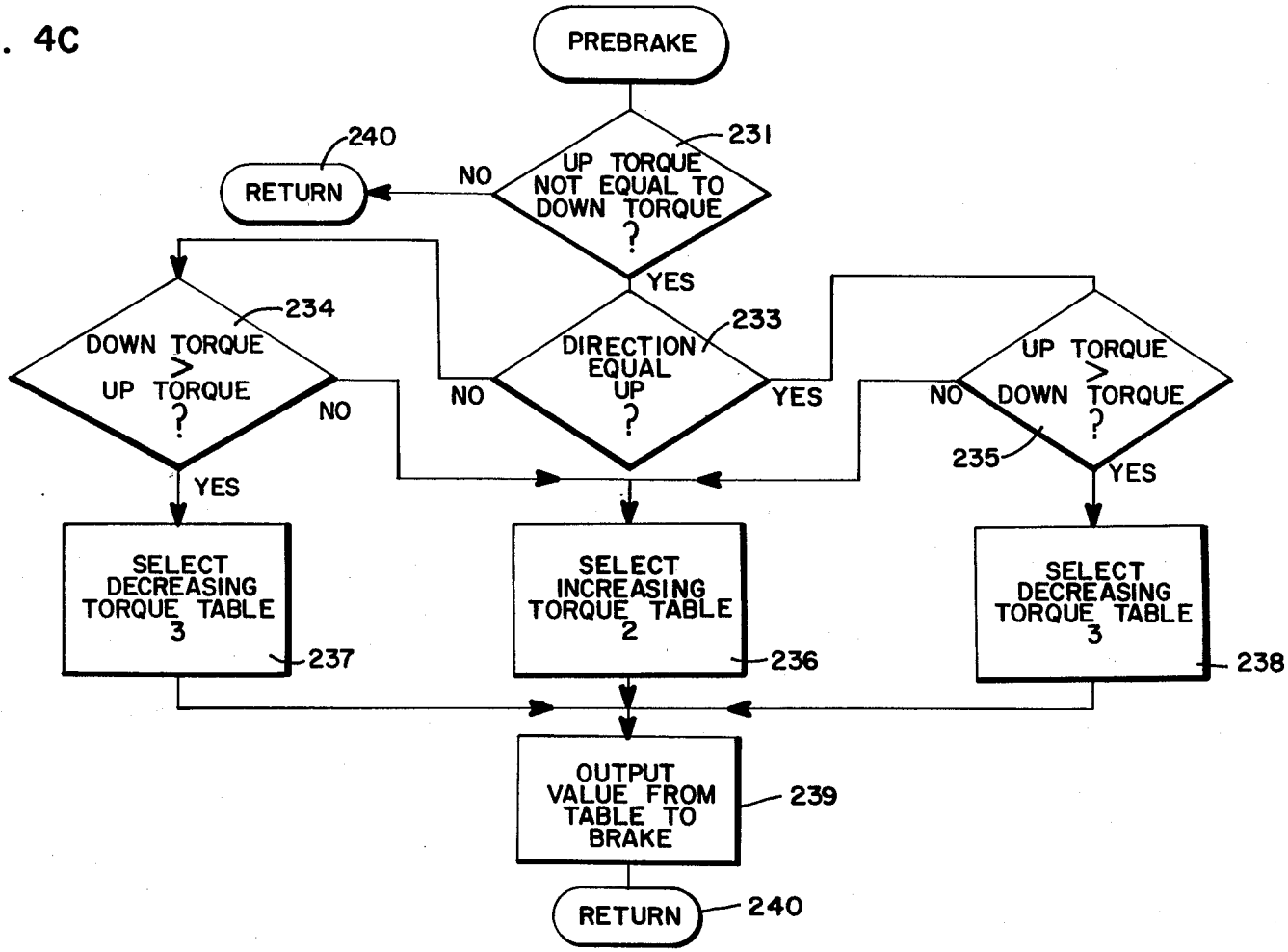
Figure 4D:
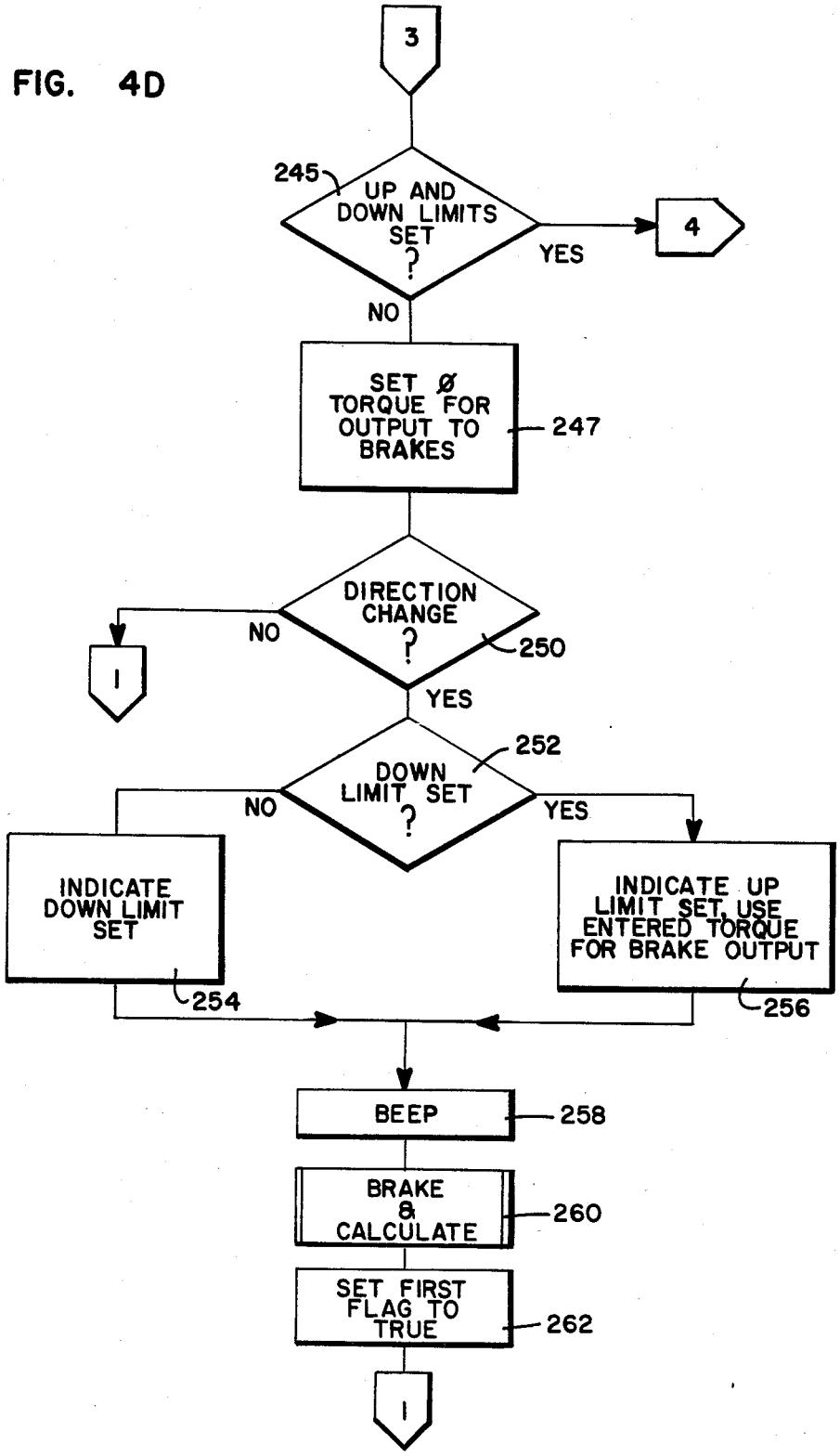
Figure 4E:
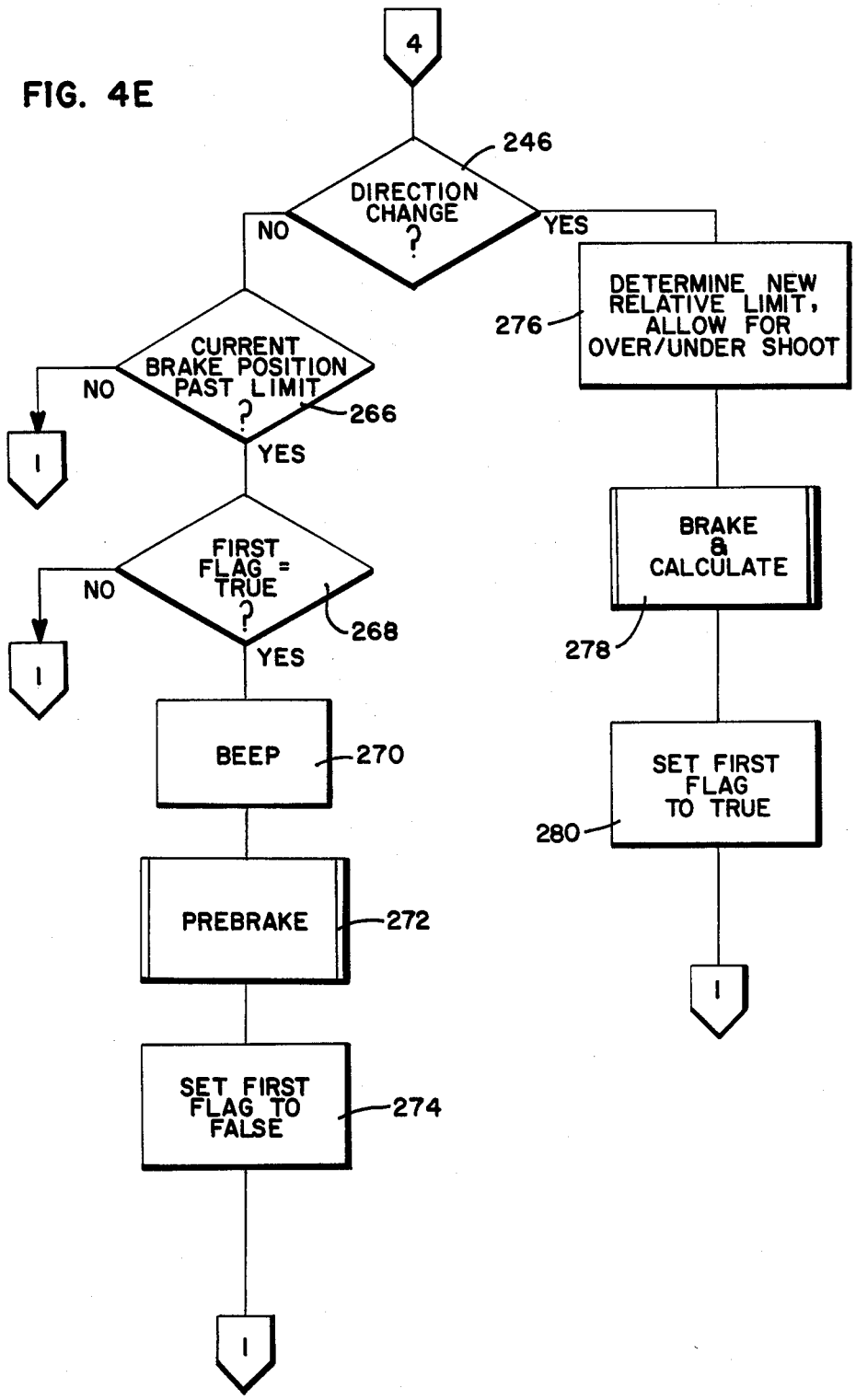
Figure 4F:
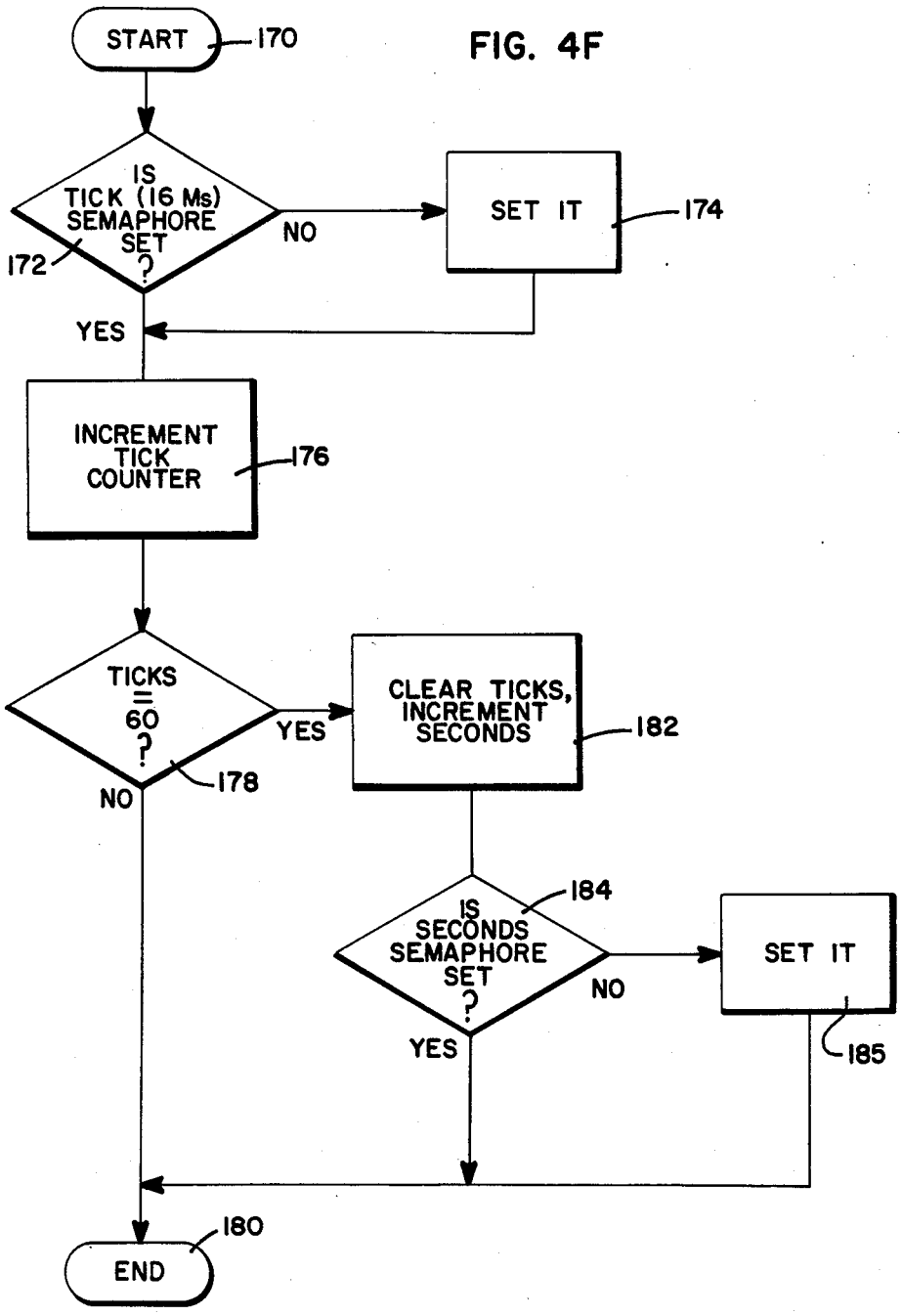
Figure 4G:
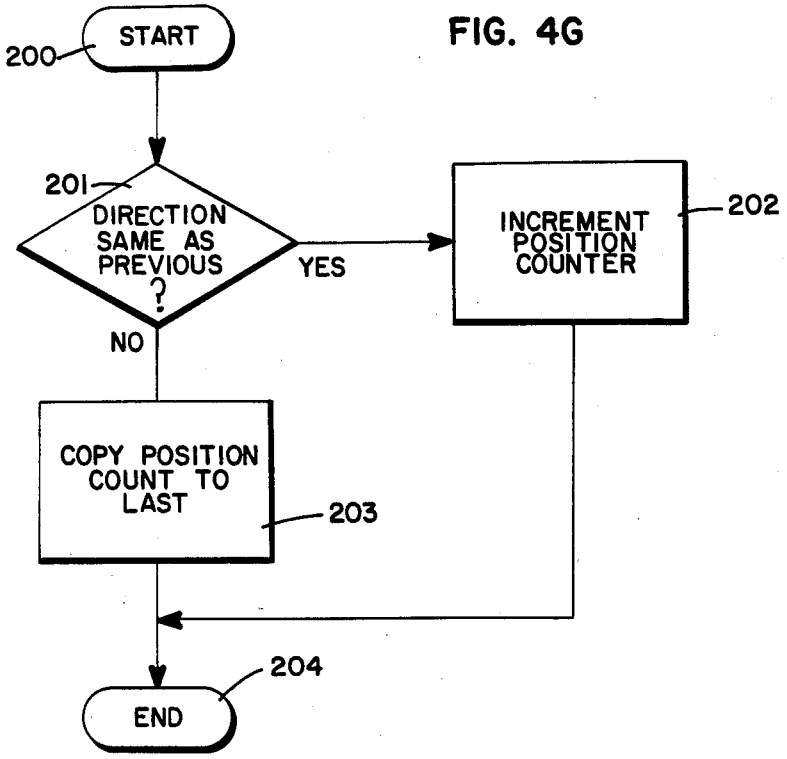

When digital encoder 90 detects a change, this triggers another interrupt routine, beginning at 200, FIG. 4G. At segment 201, a test is made as to whether the direction of movement is the same as the previous direction of movement, or whether a reversal has occurred. If the direction is the same, a position counter is incremented at segment 202, and the interrupt ends at 204. The position counter keeps track of the relative position, i.e., relative to the point at which movement in the current direction began. If at segment 201 the direct has changed, control passes to segment 203, where the position count is copied to a variable "last", which is the number of counts accumulated for movement in the just previous direction. In this manner the position encoder keeps track of relative position and changes of direction of the brake shaft.

Referring again to segment 196 of FIG. 4A, if a change of direction has occurred, it is of course necessary to apply new output values to the brakes, since in general the user may have set different resistance forces for the up and down movements, respectively, and also to update calculations of repetitions and work progress. This is done in subroutine 210. At the end of subroutine 210, control passes again to segment 154, and the main loop of the process described above repeats.

The brake and calculate subroutine 210 is shown in greater detail in FIG. 4B. Of course, in response to a change of direction, it is necessary to output a new torque value to the brakes, through digital-to-analog converter 96, which will correspond to the user-selected resistance force for that direction. However, in order to overcome the hysteresis effects discussed above, it is necessary to consider not only the user-selected torque for the new direction, but also whether this torque is a change from the previous torque, and if so, whether it is an increase or a decrease. To do this, three separate torque look-up tables are provided in memory. One corresponds to the steady-state curve 120 of FIG. 3. Another, the increasing torque table, corresponds to curve 121 of FIG. 3. The third table, known as the decreasing torque table, corresponds to curve 122 of FIG. 3. These tables contain values corresponding to current to be output to the brakes in response to selected torque value.

At segment 211, the torque (resistance) settings selected by the user for the up and down directions are compared. If they are the same, control branches to segment 212. In this case, the brakes will be operating in the steady-state condition represented by curve 120, and the hysteresis effects do not come into play. Torque table 1 is then selected and control proceeds to segment 225.

If, however, the selected torques for the up and down directions are not the same, control would branch to segment 214. If the present direction of movement is up, segment 216 tests whether the user-selected torque for the up direction is greater than that for the down direction, and if so, the increasing torque table is selected at segment 217; if not, the decreasing torque table is selected at segment 218. In either case, control then proceeds to segment 225.

If the present direction were down, control would have passed from segment 214 to segment 220. If the user-selected torque for the down direction is greater than that for the up direction, the increasing torque table would be selected at segment 221; otherwise the decreasing torque table would be selected at segment 222. In either case, control branches to segment 225.

At segment 225 the output value to be applied to the brakes is selected, based on the user-selected torque value and whichever of the three torque tables has just been selected. This value is then applied to diiital-to-analog converter 196 and through the two amplifier channels to the brakes. Control then passes to segment 226, where calculations are performed. For the up direction, repetition rate and kilocalories per hour are calculated; for the down direction, the number of repetitions and the total kilocalories are calculated. Control then passes to segment 227, where a flag is set indicating that the display needs to be updated. This flag will subsequently be detected and acted on in segments 192, 193 discussed above. At 228, the brake and calculate subroutine ends and control returns to the main loop as previously described.

In the preferred embodiment, a pre-brake subroutine 230 of FIG. 4C is used in addition to brake and calculate subroutine 210, to give greater smoothness of operation. Generally, pre-brake subroutine 230 is similar to subroutine 210, without the calculation section, and it is used to anticipate changes of direction and begin applying the torque value for the new direction. It will be appreciated that the coils 112, 114 for the brakes store a large field which can take a significant time, for example, ¾ second, to collapse or change. Therefore, instead of waiting for the user to actually change directions, the system detects stoppage of the shafts lasting longer than a predetermined interval, which is 1/10 second in the preferred embodiment, and uses this as an indication that the user is about to change directions. The pre-brake routine is then used to apply the appropriate torque for the new direction even though it has not begun. Then, when the user does change directions, typically a fraction of a second later, the currents and fields in the brakes will already be on their way to the new value, resulting in smoother operation from the user's point of view.

Specifically, if there has not been a direction change yet at segment 196, control passes to segment 229 which tests whether there has been a stoppage lasting 1/10 second without a change of direction. If not, the assumption is that the current direction is continuing and control passes again to segment 154 to resume the major loop. If the answer is yes, then the pre-brake subroutine 230 is executed, following which execution resumes with the major loop at segment 154.

In pre-brake subroutine 230, segment 231 checks whether the user-selected torques for the up and down directions are equal. If they are equal, the pre-braking routine is not needed, since the new value which will eventually be output to the brakes at the brake and calculate subroutine will be the same as the previous value. Therefore, in that case control exits the pre-brake routine. If the two torques are not equal, decisions must be made to select the increasing torque table 2 or decreasing torque table 3, depending upon the present direction and whether the user-selected torque for the up direction is greater than or less than that for the down direction. This decision is made in segments 233–235, with the result that the increasing torque table is selected at segment 236 or the decreasing torque table is selected at segment 237 or 238. In either case, the output value from the selected table is output to the brake at segment 239, after which execution returns to the main loop at 240.

The limited range mode will now be described with reference to FIGS. 4D and 4E, which breaks from the main loop of FIG. 4A at segment 194, and eventually returns to it to block 154.

To engage the limited range mode, the user pushes the LIMIT RANGE button on the control panel. This will cause the microprocessor to branch at segment 194 to the limited range operation. If there have previously been up and down limits set since POWER ON, these limits will become active and the controller will emit a beep when the limits are encountered in doing the exercise. If there have been no limits previously set, then the system will "learn" new limits as the user moves the brakes through a first cycle. Also, the user can push the SET RANGE button on the control panel, which will clear any previously set limits so that new ones can be set by moving the brakes through a first cycle with the desired end points.

At program segment 245, if the up and down limits have been set, control branches to segment 246. This would correspond to normal operation in limited range mode, with the apparatus providing a beep at the preselected limits. If, however, the up and down limits have not been set, control proceeds to segment 247, which would be the program path corresponding to the user setting the limits. At segment 247 the torque value is set to zero to be subsequently output to the brakes, and control passes to segment 250. If there has not been a direction change, control returns to the main control loop, segment 154. If there has been a change, control passes to segment 252 which tests an internal flag to see whether the down limit has been set. If not, segment 254 sets a flag within the program to indicate that the down limit is set and passes control to 258. If the down limit was previously set at segment 252, control passes to segment 256, which sets a flag to indicate that the up limit is set, then uses the entered torque value for subsequent output to the brakes. In either case, control then passes to segment 258 which causes a beep to be emitted. This can be done through a well-known type of beeper transducer connected to be controlled by the microprocessor. Control then passes to segment 260, which is call to the brake and calculate subroutine, previously described. This will output zero torque to the brakes if the user is still in the process of setting the limits, or the selected torque, as described above. At segment 262, an internal program flag referred to as "first" is set to true, and control returns to the main control loop, segment 154.

After both the upper and lower limits have been set, the next time the program control passes through segment 245 it will branch to segment 246. If no direction change has occurred, control passes to segment 266. If the current brake position is not past the limit for the limited motion mode, control returns to the main loop. If it is past the limit, segment 268 tests the "first" flag. If not true, control returns to the main loop, but if the flag is true, a beep is emitted at segment 270, indicating the limit has been reached, and at segment 272 the pre-brake subroutine is executed which sets the appropriate value for the next direction of movement. The "first" flag is then set to false at segment 274 and control returns to the main program loop. Setting and testing the "first" flag in this manner provides for a single beep when a limit is passed.

When the user does change directions, segment 246 will cause branching to segment 276. This will determine the new relative limit, allowing for overshoot or undershoot which may have occurred. When moving the exercise apparatus to get the beep, the user will not stop exactly at the limit, but will probably overshoot by a certain amount. Possibly, the user may stop short of the limit range and reverse directions, which would result in an undershoot. In either case, the over- or undershoot is taken into account in calculating the relative limit which the apparatus is now moving towards, so that the actual limit will remain constant. At segment 278 the brake and calculate subroutine is executed, after which segment 280 sets the first flag to true, and control returns to the main loop.

It will thus be appreciated from the above description that the present invention provides an improved control system for an exercise machine of the type which uses electrically actuated brakes as the resistance elements for the exercise. The improved control system provides compensation for hysteresis effects in the brakes which would otherwise cause inaccuracies under certain circumstances. With the hysteresis compensation of the improved control system, the resistance force output by the machine accurately corresponds to the user-selected values, regardless of whether the selected resistance force for one direction of movement is greater than, less than, or equal to the selected resistance force for the opposite direction.

The improved controller also provides a simple to use but very effective method of setting soft limits to the range of motion as an aid to particular exercise applications. The soft limits are easily set by moving the machine through the desired range, while the system learns the desired limits, which thereafter cause the machine to emit a beep when the limits are reached, rather than hitting a hard limit.

We claim:

1. An open loop control system for an exercise machine of the type which includes at least one electrically operated resistance unit having a shaft rotatable in opposed first and second directions and having means for generating a force effective to resist shaft rotation, which force varies in accordance with electrical energization applied to the resistance unit, and attachment means for allowing the user to exert a counteracting torque on the shaft in both directions of movement thereof to achieve bidirectional exercise benefit, wherein the resistance unit is not operated in its steady state condition, the control system comprising:

(a) means for storing first and second values corresponding to selected resistance forces to be generated by the resistance unit in the first and second directions of shaft movement, respectively;

(b) means for sensing shaft movement; and (c) means responsive to said values corresponding to resistance forces and to sensed shaft movement for applying an electrical energization level to said resistance unit during each direction of movement thereof which is a function of the selected value for said direction and the relative magnitude thereof in relation to the selected value for the previous direction of movement, to compensate for transient hysteresis effects in the resistance unit and cause it to generate a resistance force for each direction which is substantially equal to the selected resistance force.

2. A control system according to claim 1 wherein said means for applying an electrical energization level includes means responsive to whether the selected value corresponding to a direction of movement is greater than, less than, or equal to, the selected value for the previous direction of movement.

3. A control system according to claim 1 wherein said means for storing includes input means for receiving input signals from the user corresponding to selected resistance forces, and memory means for storing representations of said input signals.

4. A control system according to claim 1 wherein said means for applying an electrical energization level includes first means operative when selected for producing a signal representing an energization level corresponding to the selected value for steady-state operation of the resistance unit second means operative when selected for producing a signal representing an energization level corresponding to the selected value for a condition of an increase in resistance force from the prior resistance force; third means operative when selected for producing a signal representing an energization level corresponding to the selected value for a condition of a decrease in resistance force from the prior resistance force; and means for selecting one of said first, second or third producing means dependent upon whether the selected value for the direction of movement is greater than, less than, or the same as, the selected value for the previous direction of movement.

5. An exercise machine for exercising various muscle groups, which comprises:

(a) at least one electrically operated resistance unit which includes a shaft rotatable in opposed first and second directions, the resistance unit having means for generating a force effective to resist shaft rotation which varies in accordance with electrical energization applied thereto;

(b) attachment means for allowing the user to exert a counteracting torque on the shaft in both directions of movement thereof to move the shaft through repetitive exercise cycles;

(c) control means for providing electrical energization to the force generating means in accordance with a preselected resistance force; and (d) indicator means responsive to user selected positions of said shaft for providing an indication to the user when said positions are reached during an exercise cycle to thereby define a limited range of motion for the exercise, the indicator means including means operative when activated by the user in a limited range mode for automatically determining the limits of shaft rotation when the apparatus is moved through a first exercise cycle, and for thereafter providing an indication to the user when the limits are reached during subsequent exercise cycles.

6. An open loop control system for an exercise machine of the type which includes at least one electrically operated resistance unit having a shaft rotatable in opposed first and second directions and having means for generating a force effective to resist shaft rotation, which force varies in accordance with electrical energization applied to the resistance unit, and attachment means for allowing the user to exert a counteracting torque on the shaft in both directions of movement thereof through repetitive exercise cycles to achieve bidirectional exercise benefit, wherein the resistance unit is not operated in its steady state condition, the control system comprising:

(a) means for storing first and second values corresponding to selected resistance forces to be generated by the resistance unit in the first and second directions of shaft movement, respectively;

(b) means for sensing shaft movement;

(c) means for responsive to said values corresponding to resistance forces and to sensed shaft movement for applying an electrical energization level to said resistance unit during each direction of movement thereof which is a function of the selected value for said direction; and (d) indicator means responsive to user selected positions of said shaft for providing an indication to the user when said positions are reached during an exercise cycle to thereby define a limited range of motion for the exercise, the indicator means including means operative when activated by the user in a limited range mode for automatically determining the limits of shaft rotation when the apparatus is moved through a first exercise cycle, and for thereafter providing an indication to the user when the limits are reached during subsequent exercise cycles.

7. A control system according to claim 6 wherein said means for providing an indication comprises means for providing an audible indication to the user when said selected positions are reached during an exercise cycle.

8. A control system according to claim 6 further including means operative when activated by the user in a limited range mode for determining the end positions of shaft rotation when the apparatus is moved through a first exercise cycle to select said end points as limits, and for thereafter providing an indication to the user when the limits are reached during subsequent exercise cycles.

9. A control system according to claim 8 further including means operative in said limited range mode for automatically setting the resistance force to a predetermined small value when the apparatus is moved through said first exercise cycle.

* * * * *